US006729688B2

(12) United States Patent
Erne

(10) Patent No.: US 6,729,688 B2
(45) Date of Patent: May 4, 2004

(54) SEAT AND BACKSEAT ASSEMBLY FOR SEATING, IN PARTICULAR OFFICE CHAIRS

(75) Inventor: Anton Erne, Full (CH)

(73) Assignee: Giroflex-Entwicklungs-AG, Koblenz (CH)

( * ) Notice: Subject to any disclaimer, the term of this patent is extended or adjusted under 35 U.S.C. 154(b) by 0 days.

(21) Appl. No.: 10/239,578

(22) PCT Filed: Mar. 19, 2001

(86) PCT No.: PCT/CH01/00168

§ 371 (c)(1),
(2), (4) Date: Sep. 24, 2002

(87) PCT Pub. No.: WO01/70074

PCT Pub. Date: Sep. 27, 2001

(65) Prior Publication Data

US 2003/0052520 A1 Mar. 20, 2003

(30) Foreign Application Priority Data

Mar. 24, 2000 (CH) ..... 0570/00

(51) Int. Cl.[7] ..... A47C 1/032

(52) U.S. Cl. ..... 297/302.1; 297/300.2; 297/303.1; 297/320; 297/268.1

(58) Field of Search ..... 297/300.2, 302.1, 297/303.1, 320, 268.1, 297, 301.1; 248/580, 581, 582, 583, 584, 589, 591, 602, 372.1, 398, 592, 594, 595

(56) References Cited

U.S. PATENT DOCUMENTS

| | | | | | |
|---|---|---|---|---|---|
| 2,830,650 | A | * | 4/1958 | Lorenz | 297/79 |
| 2,956,619 | A | | 10/1960 | Scherer | |
| 3,740,792 | A | * | 6/1973 | Werner | 16/298 |
| 4,384,741 | A | * | 5/1983 | Flum et al. | 297/300.5 |
| 4,575,150 | A | * | 3/1986 | Smith | 297/300.4 |
| 4,889,335 | A | | 12/1989 | Chen | |
| 4,889,385 | A | * | 12/1989 | Chadwick et al. | 297/300.1 |
| 5,080,318 | A | * | 1/1992 | Takamatsu et al. | 248/598 |
| 5,121,934 | A | * | 6/1992 | Decker et al. | 297/300.8 |
| 5,288,138 | A | * | 2/1994 | Stulik et al. | 297/302.1 |
| 5,308,144 | A | * | 5/1994 | Korn | 297/300.2 |
| 5,348,372 | A | * | 9/1994 | Takamatsu et al. | 297/303.1 |
| 5,366,274 | A | * | 11/1994 | Roericht et al. | 297/321 |
| 5,582,459 | A | * | 12/1996 | Hama et al. | 297/300.2 |
| 5,584,533 | A | * | 12/1996 | Schrewe | 297/300.2 |
| 5,782,534 | A | * | 7/1998 | Desanta | 297/423.13 |
| 5,810,440 | A | * | 9/1998 | Unwalla | 297/316 |
| 5,826,940 | A | | 10/1998 | Hodgdon | |
| 5,971,481 | A | * | 10/1999 | Emmenegger et al. | 297/300.8 |
| 6,000,755 | A | * | 12/1999 | Uhlenbrock | 297/300.2 |
| 6,431,649 | B1 | * | 8/2002 | Hensel | 297/300.2 |

FOREIGN PATENT DOCUMENTS

| | | | | |
|---|---|---|---|---|
| CH | 659 179 | A | 1/1987 | |
| EP | 284272 | A1 * | 9/1988 | A47C/3/026 |
| EP | 0 954 997 | A | 11/1999 | |
| FR | 2594663 | A1 * | 8/1987 | A47C/1/032 |
| TW | 366756 | | 11/1999 | |

* cited by examiner

*Primary Examiner*—Peter M. Cuomo
*Assistant Examiner*—Stephen D'Adamo
(74) *Attorney, Agent, or Firm*—Venable LLP; Stuart I. Smith

(57) ABSTRACT

The invention relates to seat and backrest arrangements in seat furniture, in particular office chairs, which comprise a seat plate, a seat-plate support and a backrest support and in which the seat plate (1), in the region of its front, knee-side edge (2), is connected moveably to the seat-plate support (3) and, in the region of its rear edge (5), is connected moveably to the backrest support (6), the backrest support (6) being coupled displaceably to the seat-plate support (3). The seat and backrest arrangements according to the invention are characterized in that a spring means (4) for cushioning the seat plate (1) and the backrest support (6) is arranged in the region of the front, knee-side edge (2) of the seat plate (1)—between the seat plate (1) and seat-plate support (3).

12 Claims, 2 Drawing Sheets

SEAT AND BACKSEAT ASSEMBLY FOR SEATING, IN PARTICULAR OFFICE CHAIRS

BACKGROUND OF THE INVENTION

The invention relates to a seat and backrest arrangement in seat furniture, in particular office chairs, which comprises a seat plate, a seat-plate support and a backrest support and in which the seat-plate, in the region of its front, knee-side edge, is connected moveably to the seat-plate support and, in the region of its rear edge, is connected moveably to the backrest support, the backrest support being coupled displaceably to the seat-plate support.

Seat and backrest arrangements of the generic type are known in particular in office chairs where it is possible—in order to obtain good seat comfort—not only to adapt the seat height, but also the seat depth and/or the backrest spring system to the specific requirements. Known office chairs which satisfy all demands are often considered to be too expensive in the market place even though the operation and design of these seat furniture items are convenient and satisfy the highest standards of quality.

A work chair or office chair of the generic type having a height-adjustable seat support, a seat plate which can be adjusted in inclination with respect to the said seat support and a backrest support whose inclination with respect to the seat plate is automatically adjusted in accordance with the inclination of the seat plate is disclosed in CH 659 179. In this "synchronous work chair" the inclination of the seat plate and the inclination of the backrest support are adjusted as a function of each other and the adjustments are cushioned by a complicated, multipart spring assembly.

SUMMARY OF THE INVENTION

This object generally is achieved according to the present invention by a seat and backrest arrangement for seat furniture, in particular office chairs, which comprises: a seat plate, a seat-plate support and a backrest support and in which the seat-plate, in the region of its front, knee-side edge, is connected moveably to the seat-plate support and, in the region of its rear edge, is connected moveably to the backrest support, the backrest support is coupled displaceably to the seat-plate support, and a spring means for cushioning the seat plate and the backrest support is arranged in the region of the front, knee-side edge of the seat plate between the seat plate and seat-plate support. Preferred embodiments and developments of the seat and backrest arrangement according to the invention and of corresponding seat furniture and office chairs emerge from the discussion of the invention below.

Exemplary embodiments of the invention are explained in greater detail below—without, however, wanting to restrict the scope of the invention—with reference to schematic drawings.

DETAILED DESCRIPTION OF THE INVENTION

Figure 1:
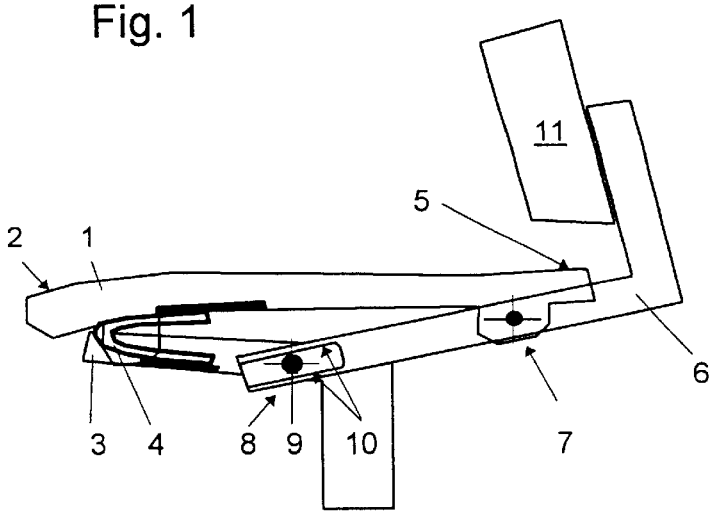
FIG. 1 shows a cross section through a seat and backrest arrangement according to the invention, in accordance with a first embodiment, having a seat-plate and backrest-support spring system.

FIG. 1 shows a cross section through a seat and backrest arrangement according to the invention, in accordance with a first embodiment. In the region of its front, knee-side edge 2, the seat plate 1 is connected to the seat-plate support 3 via a spring means 4—here in the form of a U-shaped leaf spring. A person who sits down on a chair equipped in such a manner will ascertain that in the process the seat plate 1 moves slightly downwards on account of the spring action of the spring means 4. This contributes—together with a preferably upholstered seat covering—to the seat comfort often desired by the customers. As an alternative to the embodiment which is shown, a spring means 4 could also be realized in the form of one or more torsion springs (not shown) or other spring means which permit the seat plate 1 to be fastened moveably and resiliently in the region of its front, knee-side edge 2 with respect to the seat-plate support 3.

In the region of its rear edge 5, the seat plate 1 is connected moveably to the backrest support 6. This moveable connection is brought about via a first joint 7. In addition, the backrest support 6 is coupled to the seat-plate support 3 via a second joint 8. This second joint 8 contains, on each side of the seat-plate support 3, a respective roller 9 which is fastened here to the seat-plate support 3. The backrest support 6 has guides 10 which correspond to the two rollers 9 and in which the rollers 9 are arranged displaceably. As an alternative to the recesses which are shown in this embodiment and act as guides 10, the rollers 9 could also be fastened to the seat plate 1 and the recesses or other means for guiding the rollers 9 (such as rails and the like) could be arranged on the seat-plate support 3.

If a person sits down on this chair, the seat plate 1, and together with it the first joint 7, is lowered as described. As this seat plate 1 is connected moveably to the backrest support 6 via the first joint 7, the backrest support 6 is also moved downwards somewhat. The backrest support 6 is able to execute this movement because it is coupled displaceably to the seat-plate support 3 in the described manner. Because of this displacement of the backrest support 6 downwards, the arrangement of the spring means 4 and of the two joints 7, 8 necessarily results in a slight movement of the backrest 11 rearwards. The mechanism here is therefore what is referred to as a synchronous mechanism by means of which the seat plate 1 and the backrest support 6 and the backrest 11 are cushioned by a spring means 4 and the two joints 7, 8. The heavier a person is, the more the seat plate 1 and the backrest 11 are moved synchronously to each other in the described manner. If the person stands up, in this first and most simple embodiment of the seat and backrest arrangement according to the invention both the backrest 11 and the seat plate 1 are moved back into their original position again by the spring means 4.

If the person leans backwards against the backrest, this additional pressure against the backrest 11—which is connected to the seat plate 1 via the backrest support 6 and the two joints 7, 8—has the effect that first the backrest 11 yields somewhat to the rear and that secondly (because of the resultant lever action), the seat plate 1 is lowered somewhat. The spring means 4 opposes these two movements and so this can again refer to a synchronous mechanism. In actual fact, in seat furniture, in particular office chairs, the seat and backrest arrangement according to the invention requires just one spring means 4 for cushioning this synchronous mechanism.

Figure 2:
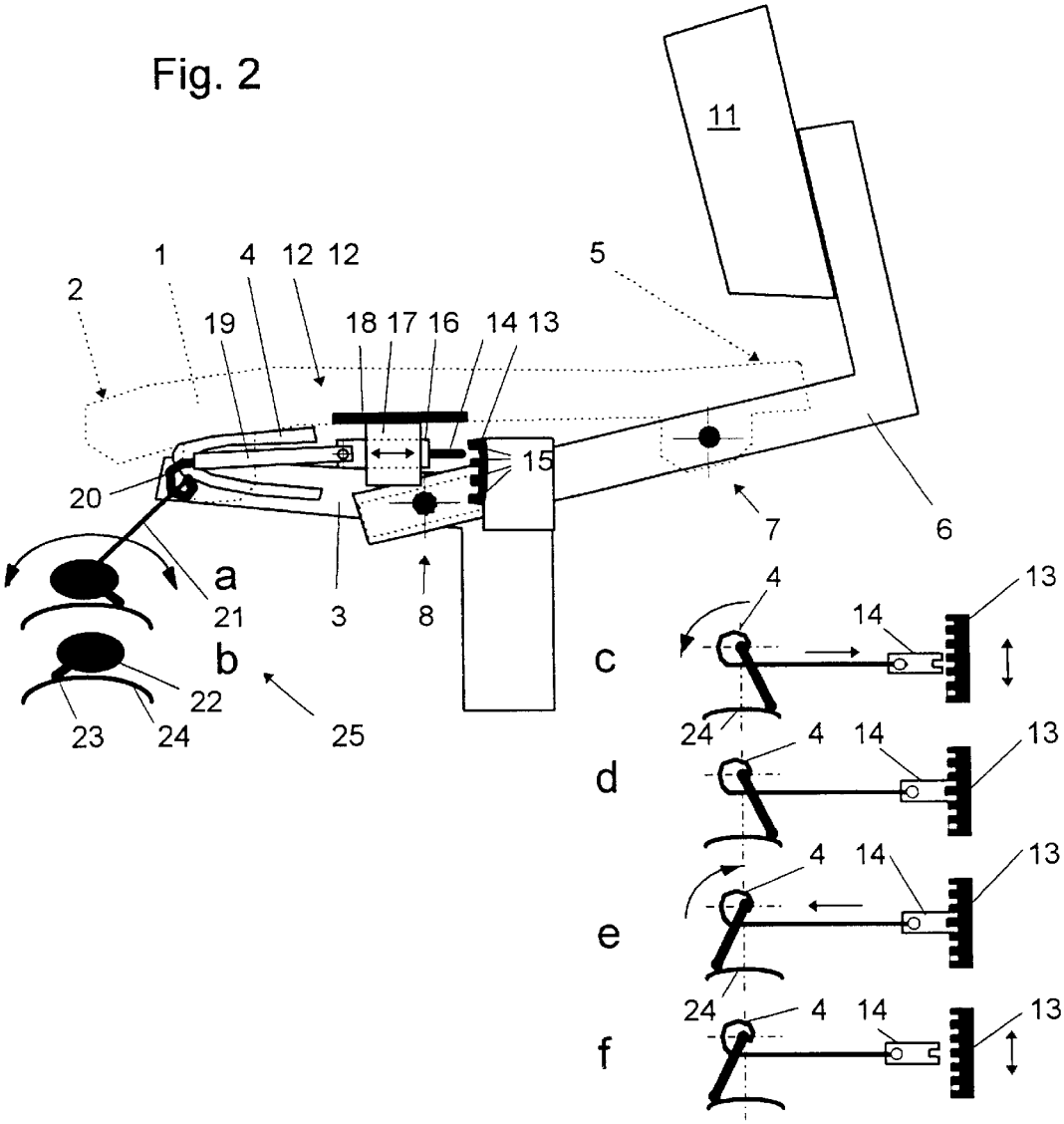
FIG. 2 shows a cross section—corresponding to FIG. 1—having a mechanism for blocking the seat-plate and backrest-support spring system.

A first embodiment of this seat and backrest arrangement according to the invention is also illustrated in FIG. 2. So as to be able to eliminate rocking of the office chair which may be unpleasant when sitting, this embodiment also contains a mechanism for blocking the seat-plate and backrest-support spring system. This mechanism comprises a tongue 12 which can be brought into engagement with a grid element 13. In this embodiment, the tongue 12 comprises a grid bolt 14 which can engage between the teeth 15 of the grid element 13. The grid bolt 14 is fastened to a piston 16 which is arranged displaceably in a guide cylinder 17. The guide cylinder 17 is fastened to the lower side 18 of the seat plate 1, and the grid element 13 is fastened to the seat-plate support 3. The spring element 4 in the region of the front, knee-side edge 2 of the seat plate 1 acts as a joint between the seat plate 1 and seat-plate support 3. The moveability of this spring means 4 is blocked by engagement of the tongue 12 or its grid bolt 14 on the grid element 13 since a stable connection between the seat plate 1 and seat-plate support 3 is thus provided. The tongue 12 also contains an activator rod 19 which connects the piston 16 to a spring element 20. An operating rod 21, which preferably has an operating knob 22 at its end, engages on the spring element 20, which is designed as a torsion spring. The operating knob comprises a projection 23 which is acted upon by a spring system 24.

If the operating knob 22 is located in position a (cf. FIG. 2) a torque acts on the spring element 20. The torsion spring pulls on the activator rod 19 and therefore on the piston 16 and on the grid bolt 14. The tongue 12 is (as illustrated in FIG. 2) in the adjustment position. The blocking mechanism therefore contains a locking means 25 with which the tongue 12 can be kept from engaging in the grid element 13.

If the operating knob 22 is rotated into position b (cf. FIG. 2), an opposed torque acts on the spring element 20. The torsion spring pushes against the activator rod 19 and therefore against the piston 16 and against the grid bolt 14: the tongue 12 is in the locking or blocking position.

During the change from position a to position b the projection 23 of the operating knob 22 has to overcome the resistance of the spring system 24. This resistance is sufficient for it not to be possible for the operating knob 22 to unintentionally rotate into its respective other position, even though there is always a torque between the operating knob 22 and spring element 20. The torsion spring thereby always exerts a force on the grid bolt 14, with the result that the latter always attempts to take up the corresponding end position. If, during the attempt to block the seat-plate and backrest-support spring system, the grid bolt 14 strikes precisely against a tooth 15 of the grid element 13, when the seat plate 1 is relieved of load or subjected to additional weight, the grid bolt 14 will automatically snap into the nearest gap.

Departing from the illustration in FIGS. 2*a* and 2*b*, the blocking mechanism may be realized in a completely different manner: for example, the tongue 12 can be arranged displaceably on the seat plate support 3 and the grid element can be arranged on the seat plate 1. It is also possible for the spring element 20 to be designed as a leaf spring, for example. Likewise, the shape and arrangement of the operating rod 21 and operating knob 22 and of the spring system 24 are left to the discretion of an expert, provided that at least the functions which have been described are ensured.

For example, the selection of a tilting lever, as is revealed from FIGS. 2*c* to 2*d*, in place of the operating knob 22 has likewise proven successful. This tilting lever serves as what is referred to as a pre-selector arm which can be rotated into position c. Positioning of the grid bolt 14, which is designed here as two teeth, takes place. The spring means 4, which is designed as a torsion spring, builds up prestress (see arrow in FIG. 2*c*) and presses the grid bolt 14 against the grid element 13. If the grid bolt 14 and grid element 13 do not precisely coincide, the grid bolt 14 is unable to engage in the grid element 13 (cf. FIG. 2*c*). The preselector arm is unable to pivot back into its original position because of the spring system 24 which presses against the preselector arm.

A vertical movement of the grid bolt 14 with respect to the grid element 13 (by means of the seat being subjected to or relieved of a small load) enables the grid bolt 14 to latch in place by itself—on account of the constant prestress of the torsion spring (FIG. 2*d*).

If another locking position is desired, the preselector arm can be rotated onto the other side so that the positioning is cancelled. The torsion spring builds up stress in the opposite direction (see arrow in FIG. 2*e*) and pulls against the grid bolt 14. However, the latter is unable to leave the grid element 13 since the stress produced by the spring element 14 and by the weight of the seated person means that the frictional forces between the teeth of the grid element 13 and the grid bolt 14 are too great (FIG. 2*e*). The preselector arm is unable to pivot back into its previous position because of the spring system 24 which pushes against the preselector arm.

Only by means of a vertical movement of the grid bolt 14 with respect to the grid element 13 (by means of the seat being subjected to or relieved of a small load) are the frictional forces cancelled and the grid bolt 14 pulled back by itself on account of the constant prestress of the torsion spring (FIG. 2*f*) This embodiment avoids it being possible for the seat to spring up unintentionally when the position of the tilting lever is changed in order to move the grid bolt.

Figure 3:
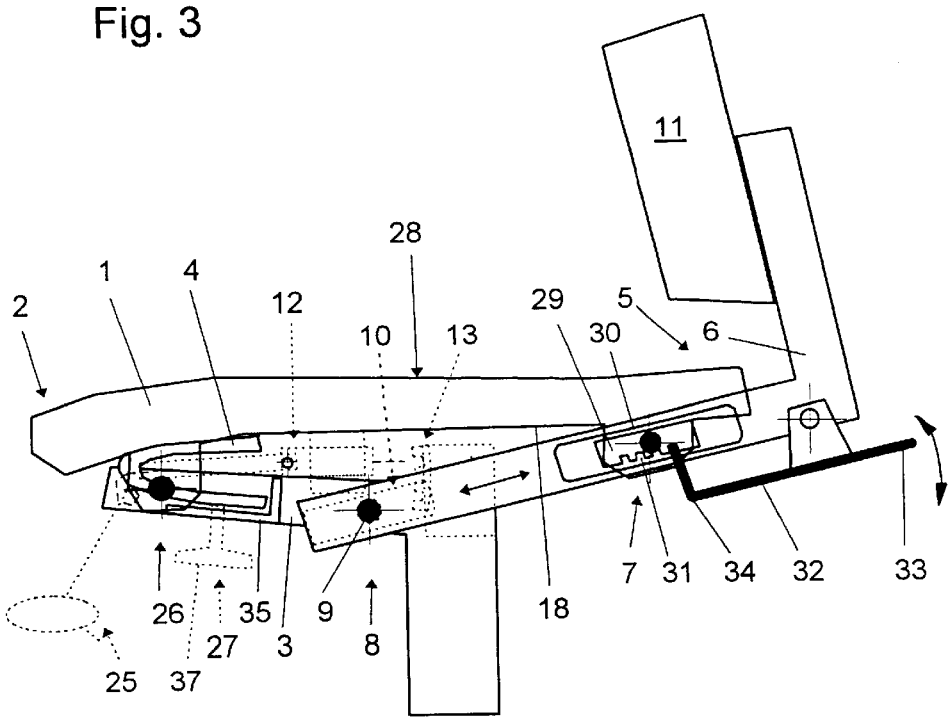
FIG. 3 shows a cross section through a seat and backrest arrangement according to the invention, in accordance with a second embodiment, having an additional seat-depth adjustment.

FIG. 3 shows a seat and backrest arrangement according to the invention, in accordance with a second embodiment. This embodiment differs from the first by virtue of the fact that a third joint 26 is arranged in the region of the front, knee-side edge of the seat plate 1 and connects this seat plate to the seat-plate support 3. The synchronous mechanism which has already been described and by means of which the seat-plate 1 and backrest support 6 and backrest 11 are cushioned by a single spring means 4 or else by a plurality of spring means 4 and the two joints 7, 8, is not impaired by the third joint 26. On the contrary, the third joint 26 makes possible the additional use of an adjusting means 27 with which the spring force of the spring means 4 can be changed. This is explained in greater detail further on with reference to FIG. 4.

The seat and backrest arrangement according to the invention which is illustrated here, in accordance with a second embodiment, contains an additional seat-depth adjustment. As already described, the backrest support 6 is coupled displaceably to the seat-plate support 3 via the second joint 8. By virtue of the fact that the first joint 7 between the seat plate 1 and backrest support 6 is likewise of displaceable design, the backrest support 6 can also be displaced with respect to the seat surface 28. This is made possible by the joint 7 containing a structure 29 which is arranged displaceably in or on the backrest support 6. For this purpose, the backrest support 6 has a guide element 30 which is designed here as a recess and in which the structure 29 is arranged in a sliding manner. In order for it to be possible to set and secure a certain position of the backrest 11 with respect to the seat surface 28, the structure 29 has grid slots 31 in which a control lever 32 engages. The control lever 32 is arranged on the backrest support 6 via a joint and is preferably pressed by a spring permanently against the structure 29 and therefore into one of the grid slots 31. By this means, the seat-depth adjustment is of lockable design.

In order to release this seat-depth adjustment, the rear part 33 of the control lever 32 can be pressed. This causes the grid part 34 of the control lever 32 to be lifted out of the corresponding slot 31 in the structure 29 and enables the backrest support 6 to be moved forwards or rearwards. In the process, the backrest support 6 is moved in a sliding manner with respect to the second joint 8, which is fixed on the seat-plate support 3, and with respect to the first joint 7, which is fixed in the region of the rear edge 5 of the seat plate 1. When the desired seat depth is reached, the control lever 32 is let go, enabling its grid part 34 to engage in a grid slot 31 in the structure 29.

A seat and backrest arrangement according to the invention and in accordance with the first embodiment (cf. FIG. 1) may also be equipped with an additional seat-depth adjustment (not shown).

Figure 4:
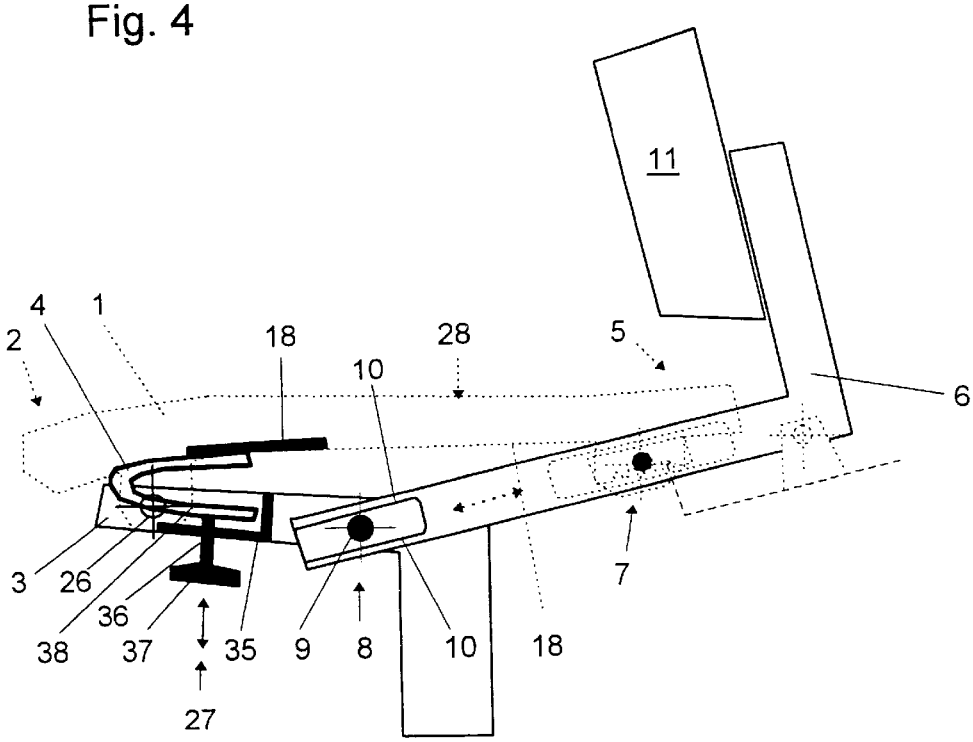
FIG. 4 shows a cross section—corresponding to FIG. 3—having and adjusting means for changing the spring force of the spring means.

FIG. 4 shows a seat and backrest arrangement according to the invention, in accordance with a second embodiment, having an additional adjusting means 27 with which the spring force of the spring means 4 can be changed. The exemplary embodiment shown contains a bearing plate 35 which is arranged on the seat-plate support 3 and in which an adjusting bolt 36 is guided via a thread. A knurled wheel 37 is fitted to the adjusting bolt 36 and can be used to change the position of the adjusting bolt with respect to the bearing plate 35 by hand. That part of the spring means 4 which acts on the seat-plate support 3 (here the lower limb 38 of the spring means 4) acts permanently on the adjusting bolt 36, with the result that adjustment of the position of this adjusting bolt causes a change in the spring force of the spring means 4.

A seat and backrest arrangement according to the invention, in accordance with the first embodiment (cf. FIG. 1), can also be equipped with such an additional adjusting means 27 with which the spring force of the spring means 4 can be changed (not shown).

As an alternative to the simple design illustrated here of an arrangement for adjusting the spring force of the spring means 4, an arrangement can be selected as is described in the international application PCT/CH97/00378 by the same applicant by reference to FIG. 8: the bearing plate is arranged inclined with respect to the seat-plate support and has a guide plate running essentially perpendicularly with respect to the bearing plate. A control spindle which extends essentially parallel to the guide plate is fastened rotatably to the bearing plate, passes through the latter and at its head end has a rotating knob for rotating the control spindle. At its rear end, the control spindle is mounted opposite the guide plate. A control structure having a corresponding internal thread is in permanent engagement by means of the external thread of the control spindle, which extends through this control structure, with the result that when the control spindle is rotated, the distance of the control structure from the bearing plate changes. Fitted to the side of the control structure is at least one roller which rolls along the guide plate and always moves together with the control structure.

This roller is—corresponding to the illustration in FIG. 4—acted upon by that part of the spring means 4 which acts on the seat-plate support 3, namely here by the lower limb 38 of the spring means 4, with the result that the lower limb 38 and the guide plate are at an acute angle to each other. When the position of the control structure and of the roller connected to it changes, this roller rolls along the guide plate, which acts as a slanting plane with respect to the lower limb 38, and moves upwards or downwards in accordance with the lower limb 38. The advantage of this arrangement resides in the fact that even a very pronounced spring force of the spring means 4 can be changed with minimal effort. The force which a person has to apply for adjustment purposes is defined, on the one hand, by the angle which is formed between the lower limb 38 of the leaf spring 4 and the guide plate of this arrangement. On the other hand, the slope of the adjusting spindle also influences this adjusting force.

In all of the figures, the same reference numbers have been used for corresponding parts. Any desired combinations of the embodiments which have been shown and/or described belong to the scope of the invention.

The advantages of this seat and backrest arrangement in seat furniture, but also the advantages of such seat furniture and office chairs as compared with the prior art include the following:

The spring means 4, in particular if the latter is designed as a U-shaped leaf spring or the like (with identical action), makes possible a very flat mechanism construction and also makes possible and assists a synchronous mechanism with regard to the spring system of the seat and backrest.

The simple design and the use of few, but generally multifunctional parts makes possible more simple and rapid installation and also guarantees optimum quality.

What is claimed is:

1. Seat and backrest arrangement for seat furniture, in particular office chairs, which comprises: a seat plate, a seat-plate support and a backrest support and in which the seat-plate (1), in a region of its front, knee-side edge (2), is connected moveably to the seat-plate support (3) and, in a region of its rear edge (5), is connected moveably to the backrest support (6) for pivotal movement, the backrest support (6) is coupled displaceably to the seat-plate support (3) for pivotal movement about a floating linearly displaceable pivot axis, and a spring means (4) for cushioning the seat plate (1) and the backrest support (6) is arranged in the region of the front, knee-side edge (2) of the seat plate (1), between the seat plate (1) and seat-plate support (3) to movably connect the seat plate to the seat-plate support.

2. Seat and backrest arrangement according to claim 1, wherein the spring means (4) is a U-shaped leaf spring.

3. Seat furniture, in particular office chairs, wherein the said furniture includes a seat and backrest arrangement according to claim 1.

4. Seat and backrest arrangement according to claim 1, wherein the seat plate (1) is connected to the backrest support (6) via a first pivot joint (7).

5. Seat and backrest arrangement according to claim 4, wherein the first pivot joint (7) between the seat plate (1) and backrest support (6) is disposed in a structure (29) which is arranged for linear displacement and lockably in or on the backrest support (6).

6. Seat and backrest arrangement according to claim 1, wherein the seat plate (1) is further connected to the seat-plate support (3) via a pivot joint (26) disposed adjacent the spring means.

7. Seat and backrest arrangement according to claim 6, wherein an adjusting means (27) is arranged on the seat-plate support (3) and/or on the seat plate (1) and can be used to change the spring force of the spring means (4).

8. Seat and backrest arrangement according to claim 1, further including a blocking mechanism for blocking pivotal movement of the seat-plate and backrest-support and spring arrangement.

9. Seat and backrest arrangement according to claim 8, wherein the blocking mechanism contains a tongue (12) which can be brought into engagement with a grid element (13).

10. Seat and backrest arrangement according to claim 9, wherein the tongue (12) is arranged displaceably on the seat plate (1) or on the seat-plate support (3), and the grid element (13) is arranged, respectively on the seat-plate support (3) or on the seat plate (1).

11. Seat and backrest arrangement according to claim 9, wherein the blocking mechanism contains a spring element (20) with which the tongue (12) can be held in engagement with the grid element (13).

12. Seat and backrest arrangement according to claim 9, wherein the blocking mechanism also contains a locking means (25) with which the tongue (12) can be stopped from engaging in the grid element (13).

* * * * *